United States Patent [19]

Land

[11] 4,168,166

[45] Sep. 18, 1979

[54] PHOTOGRAPHIC PROCESSING COMPOSITION COMPRISING BORATE

[75] Inventor: Edwin H. Land, Cambridge, Mass.

[73] Assignee: Polaroid Corporation, Cambridge, Mass.

[21] Appl. No.: 897,940

[22] Filed: Apr. 4, 1978

Related U.S. Application Data

[63] Continuation-in-part of Ser. No. 849,963, Nov. 9, 1977, abandoned.

[51] Int. Cl.[2] ..... G03C 5/54; G03C 5/38; G03C 5/30; G03C 7/00

[52] U.S. Cl. ..... 96/3; 96/29 R; 96/61 R; 96/61 M; 96/66.4

[58] Field of Search ..... 96/61 M, 61 R, 3, 29 R, 96/66.4, 66 R

[56] References Cited

U.S. PATENT DOCUMENTS

| | | | |
|---|---|---|---|
| 2,136,968 | 11/1938 | Doran | 96/66.3 |
| 2,147,441 | 2/1939 | Holt | 96/66.3 |
| 2,543,181 | 2/1951 | Land | 96/29 R |
| 2,603,565 | 7/1952 | Land | 96/61 M |
| 2,647,056 | 7/1953 | Land | 96/29 R |
| 2,726,154 | 12/1955 | Land | 96/29 R |
| 2,857,274 | 10/1958 | Land et al. | 96/29 R |
| 2,861,885 | 11/1958 | Land | 96/29 R |
| 2,944,894 | 7/1960 | Land | 96/29 R |
| 3,353,957 | 11/1967 | Blake | 96/29 R |
| 3,536,488 | 10/1970 | Land | 96/29 R |
| 3,615,127 | 10/1971 | Land | 362/78 |
| 3,615,426 | 10/1971 | Debruyn | 96/29 R |
| 3,615,427 | 10/1971 | Debruyn | 96/29 R |
| 3,615,428 | 10/1971 | Weed | 96/29 R |
| 3,615,429 | 10/1971 | Weed | 96/29 R |
| 3,615,440 | 10/1971 | Bloom et al. | 96/66 R |
| 3,650,741 | 3/1972 | Vandeputte et al. | 96/66 R |
| 3,730,716 | 5/1973 | Land et al. | 96/29 R |
| 3,894,871 | 7/1975 | Land | 96/29 R |
| 4,056,392 | 11/1977 | Scott | 96/29 R |

*Primary Examiner*—Richard L. Schilling
*Attorney, Agent, or Firm*—Philip G. Kiely

[57] ABSTRACT

A processing composition adapted for use in a silver diffusion transfer film unit which includes an alkali soluble borate compound.

19 Claims, No Drawings

PHOTOGRAPHIC PROCESSING COMPOSITION COMPRISING BORATE

CROSS REFERENCE TO OTHER APPLICATIONS

This application is a continuation-in-part of of copending application Ser. No. 849,963, filed Nov. 9, 1977 now abandoned.

BACKGROUND OF THE INVENTION

Procedures for preparing photographic images in silver by diffusion transfer principles are well known in the art. For the formation of the positive silver images, a latent image contained in an exposed photosensitive silver halide emulsion is developed and almost concurrently therewith, a soluble silver complex is obtained by reaction of a silver halide solvent with the unexposed and undeveloped silver halide of said emulsion. Preferably, the photosensitive silver halide emulsion is developed with a processing composition which is spread between the photosensitive element comprising the silver halide emulsion and a print-receiving element comprising, preferably, a suitable silver-precipitating layer. The processing composition effects development of the latent image in the emulsion and, substantially contemporaneously therewith, forms a soluble silver complex, for example, a thiosulfate or thiocyanate, with undeveloped silver halide. This soluble silver complex is, at least in part, transported in the direction of the print-receiving element and the silver thereof is largely precipitated in the silver precipitating element to form a positive image thereon. Procedures of this description are disclosed, for example, in U.S. Pat. No. 2,543,181 issued to Edwin H. Land. See, also, Edwin H. Land, One Step Photography, Photographic Journal, Section A, pp. 7–15, January 1950.

Additive color reproduction may be produced by exposing a photosensitive silver halide emulsion through an additive color screen having filter media or screen elements each of an individual additive color, such as red or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426; and 3,894,871.

Such film assemblies as those disclosed in the above indicated patents find particular utility in cine film systems such as, for example, the system described in U.S. Pat. No. 3,615,127 which includes a compact film cassette or container adapted to allow exposure of a film assemblage retained therein, subsequent processing of the film unit to provide the desired image record and projection of the resultant image record. Thus, the film assemblage may be exposed, processed, dried if necessary, and projected without transferring the film from its original container. The cine film system of U.S. Pat. No. 3,615,127 includes a film processing station whereupon the exposed film strip is trasported from a first storage reel, past an applicator where a moist processing composition adapted to develop to a visible condition images recorded on the film is applied and thence to a second storage reel.

Copending application Ser. No. 649,201, filed Jan. 14, 1976 (commonly assigned) discloses and claims a receiving element particularly suited for use in an additive color photographic diffusion transfer film unit which comprises a transparent support carrying an additive color screen and a layer comprising noble metal silver-precipitating nuclei and a polymer; wherein the nuclei are present in a level of about 0.1–0.3 mgs/ft$^2$, and said polymer is present at a level of from about 0.5 to 5 times the coverage of said nuclei. Preferably, the noble metal is obtained by reduction of a noble metal salt or complex, and more preferably, the noble metal is palladium. The preferred binder polymers are gelatin and hydroxyethyl cellulose.

The additive diffusion transfer film units disclosed above are processed by an aqueous alkaline processing composition which includes a silver halide developing agent and a silver halide solvent.

Silver halide solvents useful in forming the desired soluble complex with unexposed silver are well known and, for example, may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,274 issued Oct. 21, 1975, to Edwin H. Land or a pseudo uracil, such as the 4,6-dihydroxypyrimidines.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14, is preferably imparted to the processing composition, such as sodium, potassium and/or lithium hydroxide.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para-or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent, development reaction products, etc., should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer, and $\alpha$, $\beta$-enediols as disclosed in U.S. Pat. No. 3,730,716 issued to Edwin H. Land, Stanley M. Bloom and Leonard C. Farney on May 1, 1973.

The above-mentioned additive diffusion transfer film units, particularly when employed as an elongated strip in a motion picture mode, often are processed in a manner which does not provide for washing or otherwise removing or neutralizing the processing composition in the layers of the film unit. In some instances, with time the projected image exhibited dark areas of various shapes and disposition which has been attributed to crystal formation or a salting out of one or more of the processing composition reagents or processing by products in the film unit. While not intending to be bound by theory, it is believed that the crystals are derived from developer and/or silver halide solvent.

SUMMARY OF THE INVENTION

The present invention is directed to a novel photographic processing composition for use in processing a silver diffusion transfer film unit wherein said processing composition includes an aqueous alkaline solution, a silver halide developing agent, a silver halide solvent and an alkaline soluble borate compound. The processing composition of the present invention is particularly suitable for processing additive color diffusion transfer film units.

DETAILED DESCRIPTION OF THE INVENTION

By means of the present invention the aforementioned crystals or salting-out which result in the objectionable dark areas in the projected image are virtually eliminated by employing, in the processing composition, a borate compound. The presence of the borate ion provides an environment which inhibits the above-described phenomenon of salting-out.

The borate compound may be provided to the processing composition in a number of ways. Thus, substantially any borate compound which is soluble in aqueous alkali and not detrimental to the photographic process would be suitable. It should also be understood that it is not necessary that the compound be provided to the processing composition as a borate. Thus, compounds which are converted to a borate in alkaline solution are also suitable. Such compounds include boric acid, boron trihalides, metaborates, pyroborates, peroxoborates and boranes. Particularly preferred is sodium tetaborate decahydrate (borax).

Although borates, particularly sodium borate, are known as buffering agents, it has been found that merely buffering the processing composition will not eliminate the aforementioned salting-out. Other buffers, such as sodium nitrate and sodium metasilicate will not provide results obtained with borates.

The quantity of borate most effective for a given processing composition and film unit can be readily determined by a routine scoping series. The borate compound is employed at a level of about 0.25 mmol to 15 mmol of boron per 10 cc of processing composition. Preferably, at least about 2.5% by weight of sodium tetraborate decahydrate based on the weight of the processing composition is employed, (0.75 mmol/10 cc) and preferably about 3.3% by weight is employed (1.05 mmol/10 cc). Adjustments in the level of polymeric thickener may be necessary to obtain the desired viscosity. The quantity of borate employed is not critical, however, and sodium borate in the 8–10% range may be employed.

As stated above, the novel processing composition of the present invention is particularly useful in additive diffusion transfer film units and in film units where the processing composition is not removed from the film unit.

The following non-limiting examples illustrate the novel processing composition of the present invention.

EXAMPLE 1

A film unit was prepared comprising a transparent polyester film base carrying on one suface an additive color screen of approximately 1500 triplets per inch of red, blue and green filter screen elements in repetitive side-by-side relationship; a 328 mgs/ft$^2$ polyvinylidine chloride/polyvinyl formal protective overcoat layer; a nucleating layer comprising palladium nuclei prepared according to the procedure in Example 8 of application Ser. No. 649,201, filed Jan. 14, 1976 at a coverage of 0.15 mgs/ft$^2$ Pd and 0.19 mgs/ft$^2$ gelatin; an interlayer formed by coating 1.9 mgs/ft$^2$ gelatin, 2.3 mgs/ft$^2$ acetic acid and 0.19 mgs/ft$^2$ octylphenoxy polyethoxy ethanol surfactant; and hardened gelatino silver iodobromo emulsion (0.59$\mu$ mean diameter grains) coated at a coverage of about 91 mgs/ft$^2$ of gelatin and about 110 mgs/ft$^2$ of silver with about 7.18 mgs/ft$^2$ propylene glycol alginate and about 0.73 mgs/ft$^2$ of nonyl phenol polygycol ether (containing 9.5 g. of ethylene oxide) panchromatically sensitized with 5,5'-dimethyl-9-ethyl-3,3'-bis-(3-sulfopropyl) thiacarbocyanine triethylammonium salt (0.53 mg/g Ag); 5,5'-diphenyl-9-ethyl-3,3'-bis-(4-sulfobutyl) oxacarbocyanine (0.75 mg/gAg); anhydro-5,6-dichloro-1,3-diethyl-3'-(4''sulfobutyl)-benzimidazolothiacarbocyanine hydroxide (0.7 mg/gAg); and 3-(3-sulfopropyl)-3'-ethyl-4,5-benzothia-2-thiacyanine betaine (1.0 mg/gAg); red, green, green and blue sensitizers respectively; and the following antihalo top coat. The antihalo top coat referred to below is disclosed and claimed in copending application Ser. No. 383,261, filed July 27, 1973 (commonly assigned).

| Top Coat | mgs/ft$^2$ |
|---|---|
| Gelatin | 400 |
| Dow 620 (carboxylated styrene/butadiene copolymer latex Dow Chemical Co., Midland, Michigan) | 204 |
| Propylene glycol alginate | 25.7 |
| Dioctyl ester of sodium sulfosuccinate | 1.2 |
| Benzimidazole-2-thiol gold $Au^{+1}$ complex | 5. (as gold) |
| Daxad-11 (polymerized sodium salts of alkyl naphthalene sulfonic acid) Manufactured by W.R. Grace & Co. Cambridge, MA | 0.38 |
| Pyridinium bis-1,5 (1,3-diethyl-2-thiol-5-barbituric acid) pentamethine oxanol | 5.6 |
| 4-(2-chloro-4-dimethylamino benzaldehyde)-1-(p-phenyl carboxylic acid)-3-methyl pyrazolone-5 | 7 |

| Processing Composition | Weight % |
|---|---|
| Sodium hydroxide | 9.4 |
| Hydroxyethyl cellulose (sold by Hercules, Inc., Wilmington, Delaware under the trandename Natrosol 250 HH) | 0.7 |
| Tetramethyl reductic acid | 9.0 |
| Potassium bromide | 0.6 |
| Sodium sulfite 0.8 | |
| 2-methylthimethyl-4,6-dihydroxypyrimidine | 9.0 |
| 4-aminopyrazolo-[3,4d] pyrimidine | 00.2 |
| N-benzyl-2-picolinium bromide (50% solution) | 2.9 |

-continued

| | |
|---|---|
| Water | 67.6 |

Film units discribed above were formed into elongated strips and loaded into a film cassette of the type described in the above-mentioned U.S. Pat. No. 3,615,127, exposed in an automatic camera at a nominal ASA40 at 3400° K. and processed in the cassette.

Film units were processed with the above designated processing composition containing, respectively, 0, 0.8, 1.7, 2.5, 3.3 and 4.2 percent by weight of sodium borate ($Na_2B_4O_7.10H_2O$) based on the weight of the processing composition.

The processed film strips were projected four times, placed in an 100° F., 80% relative humidity chamber for 36 hours and then allowed to equilibrate for 2 hours at room temperature. The film strips were then projected and examined for crystals and the surfaces were visually inspected under visible light. The crystals evident in the control were substantially unchanged at the 0.8 and 1.7 percent levels; they were reduced significantly at the 2.5% level and virtually eliminated at the 3.3 and 4.2 percent levels without adversely altering the other properties of the film unit.

The following compounds were also tested in film units as described above:

| Example | Borate Compound | % By Weight | mmol of Boron/10cc. |
|---|---|---|---|
| 2 | Potassium Tetraborate Octahydrate | 3.3 | 4.20 |
| 3 | Zinc Hexaborate | 2.15 | 4.20 |
| 4 | Boric Acid | 2.10 | 4.20 |

The film units were exposed, processed and subjected to the above-described accelerated aging tests and showed similar effectiveness in reducing crystal formation as the sodium tetraborate.

Sensitometry of the film units described above may be advantageously modified by pre-exposure to a predetermined wavelength of light.

The support employed in the present invention is not critical. The support of film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloridepolymers; polyvinyl acetals; polyamides such as nylon; polyesters such as the polymeric films derived from ethylene glycol terephthalic acid; polymer cellulose derivatives such as cellulose acetate, triacetate, nitrate, propionate, butrate, acetate-butyrate; or acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of transmitting visible light within a predetermined wavelength range. In the most common situations the additive color screen is trichromatic and each set of color filter elements transmits light within one of the so-called primary wavelengths ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a s suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

What is claimed is:

1. A photographic processing composition adapted for use with a silver diffusion transfer film unit which comprises an aqueous alkaline solution having a pH of at least about 12, a silver halide developing agent, a silver halide solvent and a borate which is soluble in said aqueous alkaline solution wherein said borate is present at a level of about 0.25 mmol to 15 mmol of boron per 10 cc of processing composition.

2. The composition of claim 1 wherein said borate is sodium tetraborate decahydrate.

3. The composition of claim 2 wherein said sodium tetraborate decahydrate is present at a level of about 0.75 to 5 mmol of boron per 10 cc of said composition.

4. The composition as defined in claim 3 wherein said sodium borate decahydrate is present at a level of about 1 mmol of boron per 10 cc of said processing composition.

5. The composition of claim 1 wherein said silver halide developing agent is tetramethyl reductic acid.

6. The composition of claim 1 wherein said silver halide solvent is 2-methylthiomethyl-4,6-dihydroxypyrimidine.

7. The composition as defined in claim 1 which includes a polymeric thickening agent.

8. The composition of claim 1 wherein said film unit is an additive color diffusion transfer film unit.

9. A photographic processing composition having a pH of at least about 12 adapted for use with an additive color diffusion transfer film unit which comprises an aqueous sodium hydroxide solution, tetramethyl reductic acid, 2-methylthiomethyl-4,6-dihydroxy-pyrimidine, hydroxyethyl cellulose and sodium tetraborate decahydrate wherein said sodium tetraborate is present at a level of about 1 mmol per 10 cc of said composition.

10. The method which comprises contacting an exposed silver diffusion transfer film unit which comprises a support, carrying on one surface, a layer comprising silver-precipitating nuclei, and a silver halide layer; with a photographic processing composition comprising an aqueous alkaline solution having a pH of at least about 12, a silver halide developing agent, a silver halide solvent and a borate which is soluble in said aqueous alkaline solution; said borate being present at a level of about 0.25 mmol to 15 mmol of boron per 10 cc of said processing composition.

11. The method of claim 10 wherein said borate is sodium tetraborate decahydrate.

12. The method of claim 11 wherein said sodium borate is present at a level of about 1 mmol of borate per 10 cc of said processing composition.

13. The method of claim 10 which includes the step of drying said film unit without removing said processing composition.

14. The method of claim 10 wherein said film unit includes an additive color screen.

15. The method of claim 10 wherein said silver precipitating nuclei are noble metal nuclei.

16. The method of claim 15 wherein said noble metal nuclei are palladium nuclei.

17. The method of claim 10 wherein said processing composition includes a polymeric thickener.

18. The method of claim 17 wherein said polymeric thickener is hydroxyethyl cellulose.

19. The method which comprises contacting an additive color diffusion transfer film unit which comprises a transparent support carrying, in order, an additive color screen; a layer comprising palladium metal silver precipitating nuclei and gelatin; a photosensitive silver halide emulsion layer; and an anti-halation layer with a processing composition comprising an aqueous sodium hydroxide solution, having a pH of at least about 12, hydroxyethyl cellulose, tetramethyl reductic acid, 2-methylthiomethyl-4,6-dihydroxy-pyrimidine, hydroxyethyl cellulose and sodium tetraborate decahydrate at a level of about 4.2 mmol of boron per 10 cc of said processing composition.

* * * * *